US008414786B2

(12) United States Patent
Guan et al.

(10) Patent No.: US 8,414,786 B2
(45) Date of Patent: Apr. 9, 2013

(54) PLANAR HEATER STACK AND METHOD FOR MAKING PLANAR HEATER STACK WITH CAVITY WITHIN PLANAR HEATER SUBSTRATA ABOVE SUBSTRATE

(75) Inventors: Yimin Guan, Lexington, KY (US); Burton Lee Joyner, II, Lexington, KY (US); Zachary Justin Reitmeier, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1190 days.

(21) Appl. No.: 12/265,342

(22) Filed: Nov. 5, 2008

(65) Prior Publication Data

US 2010/0111509 A1 May 6, 2010

(51) Int. Cl.
*B41J 2/01* (2006.01)
*B44C 1/22* (2006.01)

(52) U.S. Cl. ..... 216/27; 216/40; 216/41; 216/49; 216/56

(58) Field of Classification Search ..... None
See application file for complete search history.

(56) References Cited

U.S. PATENT DOCUMENTS

| | | | | |
|---|---|---|---|---|
| 6,340,223 | B1 * | 1/2002 | Hirata | 347/56 |
| 6,943,037 | B2 * | 9/2005 | Anagnostopoulos et al. | 438/3 |
| 7,195,343 | B2 | 3/2007 | Anderson et al. | |
| 7,841,702 | B2 * | 11/2010 | Guan et al. | 347/56 |
| 8,042,912 | B2 * | 10/2011 | Guan et al. | 347/62 |
| 8,079,672 | B2 * | 12/2011 | Guan et al. | 347/63 |
| 8,172,370 | B2 * | 5/2012 | Reitmeier | 347/63 |
| 2003/0011659 | A1 * | 1/2003 | Ramaswami et al. | 347/61 |
| 2003/0085960 | A1 * | 5/2003 | Kim et al. | 347/65 |
| 2003/0214556 | A1 * | 11/2003 | Cabal et al. | 347/44 |
| 2004/0100535 | A1 * | 5/2004 | Song et al. | 347/63 |
| 2009/0267996 | A1 * | 10/2009 | Bell et al. | 347/62 |
| 2009/0315951 | A1 * | 12/2009 | Lebens et al. | 347/63 |

* cited by examiner

*Primary Examiner* — Anita Alanko

(57) ABSTRACT

A heater stuck includes first strata having a planar configuration supporting and forming a fluid heater element responsive to repetitive electrical activation and deactivation to produce repetitive cycles of fluid ejection from an ejection chamber above the heater element and second strata having a planar configuration coating the heater element of the first strata and being contiguous with the ejection chamber to protect the heater element. The first strata include a substrate and heater strata disposed on it and forming a cavity above the substrate and encompassed on three sides by the heater substrata. The heater substrata includes a pair of conductive layer portions constituting terminal leads disposed on the substrate at opposite sides of the cavity and a resistive layer disposed on the conductive layer portions and defining the fluid heater element that spans the top of the cavity.

10 Claims, 2 Drawing Sheets

PLANAR HEATER STACK AND METHOD FOR MAKING PLANAR HEATER STACK WITH CAVITY WITHIN PLANAR HEATER SUBSTRATA ABOVE SUBSTRATE

BACKGROUND

1. Field of the Invention

The present invention relates generally to micro-fluid ejection, devices and, more particularly, to a planar heater stack and a method for making the planar heater stack with a cavity within the planar heater substrata above the substrate thereof.

2. Description of the Related Art

Micro-fluid ejection devices have had many uses for a number of years. A common use is in a thermal inkjet printhead in the form of a heater chip. In addition to the heater chip, the inkjet printhead basically includes a source of supply of ink, a nozzle plate attached to or integrated with the heater chip, and an input/output connector, such as a tape automated bond (TAB) circuit, for electrically connecting the heater chip to a printer during use. The heater chip is made up of a plurality of resistive heater elements, each being part of a heater stack. The term "heater stack" generally refers to the structure associated with the thickness of the heater chip that includes first, or heater forming, strata made up of resistive and conductive materials in the form of layers or films on a substrate of silicon or the like and second, or protective, strata made up of passivation and cavitation materials in the form of layers or films on the first strata, all fabricated by well-known processes of deposition, patterning and etching upon the substrate of silicon. The heater stack also has one or more fluid vias or slots that are cut or etched through the thickness of the silicon substrate and the first and second strata, using these well-known, processes, and serve to fluidly connect the supply of ink to the heater stacks. A heater stack having this general construction is disclosed as prior art in U.S. Pat. No. 7,195,343, which patent is assigned to the same assignee as the present invention. The disclosure of this patent is hereby incorporated by reference herein.

Despite their seeming simplicity, construction of heater stacks requires consideration of many interrelated factors for proper functioning. The current trend for inkjet printing technology (and micro-fluid ejection devices generally) is toward lower jetting energy, greater ejection frequency, and in the case of printing, higher print speeds. A minimum quantity of thermal energy must be present on an external surface of the heater stack, above a resistive heater element therein, in order to vaporize the ink inside an ink chamber between the heater stack external surface and a nozzle in the nozzle plate so that the ink will vaporize and escape or jet through the nozzle in a well-known manner. The overall heating energy or "jetting energy" produced by the heater stack must pass through the plurality of layers of the first and second strata that form the heater stack before the requisite energy for fluid ejection reaches the external surface of the heater stack. The greater the thickness of the layers of the first strata of the heater stack, the more jetting energy that will be required before the requisite energy for ink drop formation and ejection can be reached on the heater stack external surface. However, a minimum presence of protective layers of the second strata of the heater stack is necessary to protect the resistive heater element from chemical corrosion, and from mechanical stress from the effects of cavitation.

During inkjet heater chip operation, some of the heating energy is wasted due to heating up the "heater overcoat", or the second strata, and also heating up the substrate. Since heating or jetting energy required is proportional to the volume of material of the heater stack that is heated during an ejection sequence, reducing the heater overcoat thickness, as proposed in U.S. Pat. No. 7,195,343 is one approach to reducing the jetting energy required. However, as the overcoat thickness is reduced, corrosion of the ejectors or heater elements becomes more of a factor with regard to ejection performance and quality. Another issue associated with a decrease in overcoat thickness is that heat loss to the substrate becomes a larger factor.

Thus, there is a need for an innovation that will reduce the heat loss to the substrate.

SUMMARY OF THE INVENTION

Embodiments of the present invention address certain long-felt needs in the industry, some of which are discussed above. Certain embodiments described herein involve forming the resistive and conductive layers of a heater stack in its first strata structure in a reverse or inverted order compared to the order of these layers in prior art heater stacks. In such case, the resistive layer forming the heater element of the heater stack is formed on top of or over an insulative air-gap or cavity and the conductor terminals of the conductive layer of the heater stack extend in opposite directions from the cavity and are formed under the lateral portions of the resistive layer extending in opposite directions from the heater element. The conductor terminals have their opposing facing end surfaces located at the opposite sides of the cavity and oriented substantially parallel to one another. The heater overcoat layers are deposited on the top resistive layer and lie in a substantially planar orientation and are subjected to reduced stress so that they can be reduced in their required thickness due to the fact that they are not forced to cover the maximum step height of the now nonexistent tapered ends of the conductor terminals.

Accordingly, in an aspect of the present invention, a planar heater stack for a micro-fluid ejection device includes first strata having a substantially planar configuration supporting and forming a fluid heater element responsive to repetitive electrical activation and deactivation to produce repetitive cycles of ejection of a fluid from an ejection chamber above the fluid heater element, and second strata having a substantially planar configuration coating the fluid heater element of the first strata and being contiguous with the ejection chamber. The first strata includes a substrate having a top surface and a heater substrata including a lower conductive layer disposed above the top surface of the substrate and an upper resistive layer disposed above the lower conductive layer. The lower conductive layer defines a pair of conductive terminal leads spaced apart from one another and having end surfaces facing toward one another so as to define a cavity therebetween such that the substrate underlies the cavity. The upper resistive layer overlies the conductive terminal leads and defines the fluid heater element spanning between the conductive terminal leads and overlying the cavity therebetween such that the heater substrate encompasses the cavity on three sides above the substrate. The first strata also includes a decomposed layer of sacrificial material deposed between the substrate and heater substrata and processed to provide the cavity substantially empty of the sacrificial material such that the cavity provides a means which during repetitive electrical activation insulates the fluid heater element from the substrate and thereby enables transfer heat energy from the fluid heater element into the fluid in the ejection chamber for producing ejection of the fluid therefrom substantially without transferring heat energy into the substrate.

In another aspect of the present invention, a method for making a planar heater stack includes processing one sequence of materials to produce first strata having a substantially planar configuration and including a resistive layer forming a fluid heater element responsive to repetitive electrical activation and deactivation to produce repetitive cycles of ejection of a fluid from an ejection chamber above the fluid heater element, a conductive layer disposed below and supporting the resistive layer and in turn disposed above a substrate and having spaced apart anode and cathode portions with a cavity defined therebetween and underlying the fluid heater element, and processing another sequence of materials to produce second strata having a substantially planar configuration that coats the first strata and is contiguous with the ejection chamber. In additional embodiments, the method further includes processing the first strata to produce the cavity defined below the fluid element heater and within the first strata above the substrate thereof by decomposing a sacrificial material so as to substantially empty the cavity of the sacrificial material such that during repetitive electrical activation the cavity enables the fluid heater element to transfer heat energy into the fluid in the ejection chamber for producing ejection of the fluid therefrom substantially without transferring heat energy into the substrate.

BRIEF DESCRIPTION OF THE DRAWINGS

Figure 1:
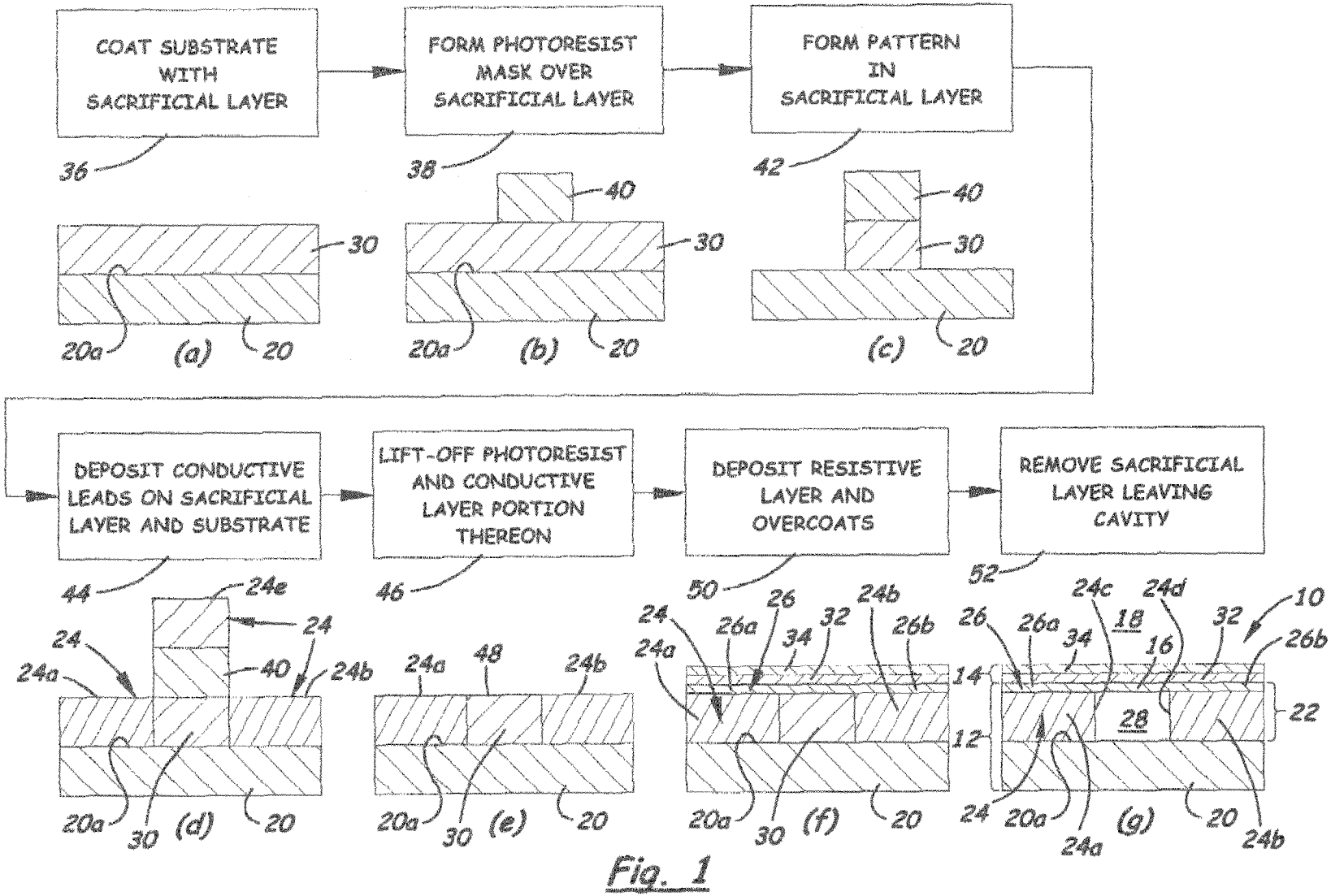

Having thus described the invention in general terms, reference will now be made to the accompanying drawings, which are not necessarily drawn to scale, and wherein:

FIG. 1 is a flow diagram, with accompanying cross-sectional schematic representations, not to scale, of a sequence of stages in making an exemplary embodiment of a heater stack of a micro-fluid ejection device in accordance with the present invention.

Figure 2:
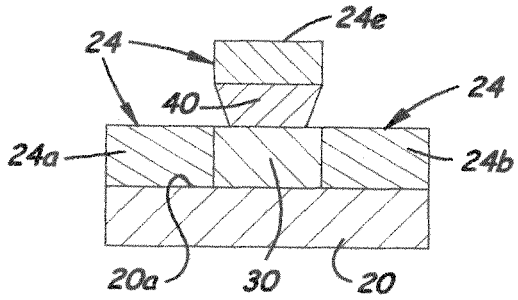

FIG. 2 is a cross-sectional schematic representation, not to scale, of an exemplary embodiment of a first approach to lifting off portions of the conductive and photoresist layers during forming the first strata of the heater stack in accordance with the present invention.

Figure 3:
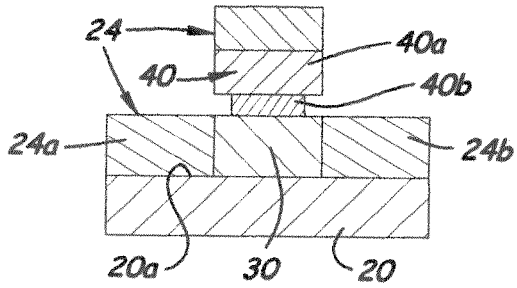

FIG. 3 is a cross-sectional schematic representation, not to scale, of an exemplary embodiment of a second approach to lifting off portions of the conductive and photoresist layers during forming the first strata of the heater stack in accordance with the present invention.

Figure 4:
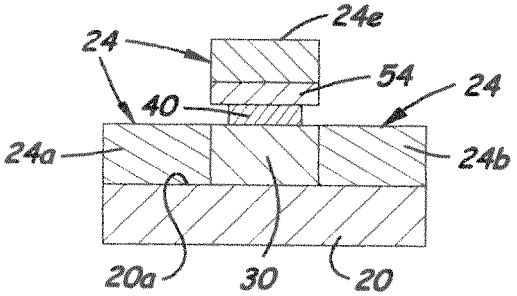

FIG. 4 is a cross-sectional schematic representation, not to scale, of an exemplary embodiment of a third approach to lifting off portions of the conductive and photoresist layers during forming the first strata of the heater stack in accordance with the present invention.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Also, the present invention applies to any micro-fluid ejection device, not just to heater stacks for thermal inkjet printheads. While the embodiments of the present invention will be described in terms of a thermal inkjet printhead, one of ordinary skill will recognize that the invention can be applied to any micro-fluid ejection system.

Referring now to FIG. 1, there is illustrated an exemplary embodiment of a heater stack, generally designated 10, of a micro-fluid ejection device in accordance with the present invention. The heater stack 10 basically includes first (or heater forming) strata, generally designated 12, and second (or protective) strata, generally designated 14. The first strata 12 have a substantially planar configuration supporting and forming a fluid heater element 16 in the heater stack 10 that is responsive to repetitive electrical activation and deactivation to produce repetitive cycles of fluid ejection from an ejection chamber 18 above the fluid heater element 12. The second strata 14 also have a substantially planar configuration coating the fluid heater element 16 of the first strata 12 and being contiguous with the ejection chamber 18 to provide protection of the fluid heater element 16 from well-known adverse effects of the repetitive cycles of fluid ejection and of fluid in the ejection chamber 18.

More particularly, the first strata 12 of the heater stack 10 includes a substrate 20 having an upper surface 20*a* and a heater substrata 22 including a lower conductive layer 24 disposed upon and above the upper surface 20*a* of the substrate 20 and an upper resistive layer 26 disposed upon and above the lower conductive layer 24. The lower conductive layer 24 defines a pair of conductive terminal leads 24*a*, 24*b*, defining an anode and a cathode, being spaced apart from one another and having end surfaces 24*c*, 24*d* facing toward one another and disposed generally parallel to one another so as to define a cavity 28 therebetween such that the substrate 20 underlies the cavity 28. The upper resistive layer 26 has spaced apart lateral portions 26*a*, 26*b* that overlie the conductive terminal leads 24*a*, 24*b* and are interconnected by the fluid heater element 16 spanning between the conductive terminal leads 24*a*, 24*b* and overlying the cavity 28 therebetween such that the heater substrata 22 encompasses the cavity 28 on three sides above the substrate 20. The anode and cathode terminal leads 24*a*, 24*b* of the conductor layer 24, being positive and negative terminals of ground and power leads electrically connected to a tab circuit (not shown), cooperate in the formation of the central portion of the resistive layer 26 into the fluid heater element 16 of the heater substrata 22 of the first strata 12. The relative positions of the conductive and resistive layers 24, 26 are the reverse in the heater stack 10 from that normally the case in the prior art, such as disclosed in the above cited U.S. Pat. No. 7,195,343. However, by way of example and not of limitation, the various layers of the first strata 12 can still be made of the various materials and have the ranges of thicknesses as set forth in above cited U.S. Pat. No. 7,195,343.

The first strata 12 also includes a decomposed layer of a predetermined sacrificial material 30, such as a suitable preselected polymer, deposed between the substrate 20 and the heater substrata 22 and processed to provide the cavity 28 substantially empty of the sacrificial material 30. The cavity 28 may be substantially gas-filled and thus provides an insulative means which during repetitive electrical activation enables the fluid heater element 16 to transfer heat energy into the fluid (not shown), such as ink, in the ejection chamber 18 located above the heater element 16 for producing ejection of the fluid therefrom, substantially without transferring heat energy into the substrate 20.

The second strata 14 of the heater stack 10 coats the resistive layer 26 of the first strata 12 to protect the resistive fluid heater element 16 thereof from the well-known adverse effects of fluid forces generated by the repetitive cycles of fluid ejection from the device. Although it could be a single layer, the second strata 14 typically include at least two layers, a passivation (protective) layer 32 and a cavitation (protective) layer 34. The function of the passivation layer 32 is primarily to protect the resistive and conductor layers 26, 24 of the first strata 12 from fluid corrosion and electrically isolate one heater from another. The function of the cavitation layer 34 is to provide protection to the fluid heater element 16 during fluid ejection operation which would cause mechanical damage to the heater stack 10 in the absence of the cavitation layer 34. By way of example and not of limitation, the various layers of the second strata 14 also can be made of the various materials and have the ranges of thicknesses as set forth in above cited U.S. Pat. No. 7,195,343.

Also in FIG. 1, there is illustrated a block flow diagram with accompanying schematic representations, not to scale, of a sequence of stages carried out in making, or building the layers of, the exemplary embodiment of the heater stack 10 of FIG. 1 in accordance with the method of the present invention. As per block 36 and schematic representation (a), the substrate 20 in the first strata 12 is provided in the form of a base wafer or layer of silicon. All the necessary logic and electrical connections have been processed and formed on the substrate 20. All the other layers of the first and second strata 12, 14, as described hereinafter, will be deposited and patterned on the substrate 20 by using selected ones of conventional thin film integrated circuit processing techniques including layer growth, chemical vapor deposition, photo resist deposition, masking, developing, etching and the like.

First, the substrate 20 is coated with the layer of sacrificial material 30, such as a selected polymer material or the like. The layer of sacrificial material 30 is deposited (spun or coated) upon the upper or front surface 20*a* of the substrate 20. The sacrificial material 30 can be a suitable preselected polymer, a chemical vapor deposited (CVD) carbon, a diamond like carbon (DLC) deposition or the like. For a polymer to be suitable for use as the sacrificial material 30, it should be compatible to current CMOS processing conditions, i.e., its decomposition temperature should be below 400° C. However, it should also maintain its structural integrity during the heater deposition step at approximately 150° C. Under the current thermal processing conditions, three of the preselected polymers that may be used are polymethylmethacrylate (PMMA), polynorbornene, and polybutylene terephthalate (PBT). Different thermal processing conditions may lead to different polymer choices. The process flow is the same with use of CVD carbon instead of polymer.

Following next, as per block 38 and the next schematic representation (b), a photoresist mask 40 is formed over the layer of sacrificial material 30 using conventional steps of photolithography. This photoresist mask 40 provides the pattern for the subsequent formation of the cavity 28. Next, as per block 42 and the next schematic representation (c), the lateral portions of the layer of sacrificial material 30 not covered by the photoresist mask 40 have been etched away which has the effect of forming or developing the pattern of the photoresist mask 40 in the remaining portion of the sacrificial material 30 underlying the photoresist mask 40 on the substrate 20. Depending on the choice of sacrificial material 30 that is used, the pattern could be formed by exposing and developing in conjunction with the photoresist mask 40, expose and develop in a separate step, or by etching using the photoresist as the mask 40 as illustrated in FIG. 1.

Following next, as per block 44 and the next schematic representation (d), the initial step in the processing of the heater substrata 22 is the deposit of a middle portion 24*e* the conductive layer 24 on the photoresist mask 40 and on the remaining portions on the front surface 20*a* of the substrate 20 on the opposite lateral sides of the remainder of the layer of sacrificial material 30 that underlies the photoresist mask 40. The latter remaining portions of the conductive layer 24 become the conductive terminal leads 24*a*, 24*b* of the conductive layer 24 in the heater substrate 22. The deposit of the conductive layer 24 can be performed by any suitable conventional technique, for example, by sputter of aluminum material to a thickness that is the same as the thickness of the layer of sacrificial material 30 that underlies the photoresist mask 40.

Then, as per block 46 and the next schematic representation (e), the lift-off of the photoresist mask 40 and with it the middle portion 24*e* of the conductive layer 24 on the front or top of the mask 40 is performed. This will leave a planar front surface 48 on the conductive terminal leads 24*a*, 24*b* and the remainder of the layer of sacrificial material 30 between the conductive terminal leads 24*a*, 24*b*. The chemical properties of the materials for achieving lift-off should be chosen based on the choice of sacrificial layer material and the lift-off photoresist material. "Lift-off" per se is an established semiconductor and MEMS manufacturing technique that is used to pattern lines (typically metals), by depositing a film over the top of a patterned polymer and subsequently removing the polymer while simultaneously removing the metal lines over it. Three alternative approaches to the performance of lift-off will be described hereinafter in reference to FIGS. 2-4.

Following next, as per block 50 and the next schematic representation (f), the heater or resistive layer 26, composed of a suitable metal material, is deposited on the planar front surface 48 to complete the deposition of the layers 24, 26 to form the first strata 12. The conductive and resistive layers 24, 26 may be selected from materials and may have thicknesses such as set forth in above cited U.S. Pat. No. 7,195,343.

Still referring to block 50 and schematic representation (f), then after the heater substrata 22 is processed, the layers making up the second strata 14 of the heater stack 10 are processed. As mentioned earlier, these layers of the second strata 14 typically include passivation and cavitation layers 32, 34. The passivation layer 32 is deposited so as to coat the resistive layer 26 of the heater substrata 22 in order to protect from fluid (ink) corrosion and electrically isolate one heater from another. The cavitation layer 34 is then deposited on the passivation layer 32 overlying the heater substrata 22. The passivation and cavitation layers of the second strata 14, also referred to as the heater overcoat in U.S. Pat. No. 7,195,343 may be selected from materials and may have thicknesses such as set forth in this patent.

Finally, as per block 52 and the next schematic representation (g), once the first and second strata 12, 14 of the heater stack 10 are processed as desired the processing of the sacrificial material 30 of the first strata 12 occurs by heating the heater stack 10 to substantially remove or decompose the sacrificial material 30. The decomposition of the sacrificial material 30 results through a thermal process with or without oxygen by bringing the substrate 20 up to the thermal decomposition temperature of the sacrificial carbon material 30. Decomposition of the sacrificial material 30 is aided with diffused oxygen from the substrate (SOG or other oxide). The decomposition products ($CO_2$ and other carbon based gases) diffuse into the substrate 20 over time, leaving the desired gas-filled cavity 22 above the substrate 20 and bounded on three sides by the heater element the heater substrata 22. It is expected that a very low percentage of residue of decomposed sacrificial material 30 is left in the cavity 28. The resulting structure is the planar heater stack 10 with an air gap in the form of the cavity 28 underneath the active heater area provided by the heater element 16.

Referring now to FIGS. 2-4, there is illustrated three alternative approaches for successfully forming a reentrant or undercut profile prior to lift-off which corresponds to the block 44 and schematic representation (d) of FIG. 1. FIG. 2 depicts an approach involving application of conventional photolithography with overexposure. This results in a desired re-entrant profile for the photoresist mask 40. FIG. 3 depicts a dual layer resist approach. It uses two resist layers 40*a*, 40*b*. The bottom layer 40*b* is not photosensitive but can be etched with standard photoresist developers. The top layer 40*a* is a conventional photoresist. Exposing and developing the top photoresist layer 40*a* results in undercutting of the bottom non-photosensitive layer. FIG. 4 depicts a surface modified resist approach. The top surface of the photoresist layer 40 is chemically modified using a suitable solvent agent, such as chlorobenzene or toluene, to result in a surface layer 54 that develops more slowly than the unmodified bulk of the photoresist layer 40. The result is similar to the dual resist process of FIG. 3 but with only one material and one spin coat required.

Embodiments of the present invention are directed to forming an air gap or cavity 28 under the heater element 16 of the heater stack 10 by use of a layer of sacrificial material 30 in conjunction with a lift-off process to result in the heater stack 10 that encompasses the air-gap or cavity 28 and is more planar than conventional heater stacks formed with the typical tapered conductive layer inner ends on its terminal leads. The improved planarity of the heater stack 10 allows for a reduction in the required thickness of the heater overcoats due to the decrease in the maximum step height that must be covered and reduced stress in the films of the overcoat when not forced to cover the tapered power leads. A component in the method of certain embodiments is forming the proper profile of the photoresist mask 40 to allow for easy lift-off of the middle portion 24*e* of the conductive layer 24. Should the photoresist mask 40 be tapered in the wrong direction (not undercut), the covering or overlying middle portion 24*e* of the conductive layer 14 would be formed continuous with terminal leads 24*a*, 24*b* making lift-off more difficult. Successful lift-off can be accomplished using any of the three alternative approaches of FIGS. 2-4, as disclosed in detail above.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A method for making a planar heater stack for a microfluid ejection device, comprising:

processing one sequence of materials to produce first strata having a substantially planar configuration and including a resistive layer forming a fluid heater element responsive to repetitive electrical activation and deactivation to produce repetitive cycles of ejection of a fluid from an ejection chamber above the fluid heater element, a conductive layer disposed below and supporting the resistive layer and in turn disposed above a substrate and having spaced apart anode and cathode portions with a cavity defined therebetween and underlying the fluid heater element; and processing another sequence of materials to produce second strata having a substantially planar configuration, that coats the fluid heater element of the first strata and is contiguous with the ejection chamber.

2. The method of claim 1 further comprising: processing the first strata to produce the cavity defined below the fluid element heater and within the first strata above the substrate thereof by decomposing a sacrificial material so as to substantially empty the cavity of the sacrificial material such that during repetitive electrical activation the cavity enables the fluid heater element to transfer heat energy into the fluid in the ejection chamber for producing ejection of the fluid therefrom substantially without transferring heat energy into the substrate.

3. The method of claim 1 wherein, said processing the one sequence of materials further includes:

depositing a layer of sacrificial material on the substrate;

forming a mask on a middle portion, of the layer of sacrificial material;

forming a pattern of the mask in the layer of sacrificial material so as to remove opposite side portions of the layer of sacrificial material from side portions of the substrate, leaving the middle portion thereof underlying the mask; and depositing the conductive layer in the form of a middle portion on the mask and opposite terminal leads on the side portions of the substrate.

4. The method of claim 3 wherein said processing the one sequence of material, also includes lifting off the mask and middle portion of the conductive layer on the mask, leaving the middle portion of sacrificial material between the opposite terminal leads of the conductive layer.

5. The method of claim 4 wherein said processing the one sequence of materials further includes depositing the resistive layer on the middle portion of sacrificial material and the opposite terminal, leads of the conductive layer.

6. The method of claim 5 wherein said processing the one sequence of materials further includes decomposing the middle portion of sacrificial material so as to leave the cavity within the first strata between the terminal leads of the conductive layer, below the heater element of the resistive layer and above the substrate.

7. The method of claim 4 wherein said processing the one sequence of materials also includes forming a reentrant profile on the mask prior to depositing the middle portion of the conductive layer on the mask followed by lifting off the mask and middle portion of the conductive layer.

8. The method of claim 4 wherein said processing the one sequence of materials also includes forming the mask with bottom and top resist layers on the middle portion of the layer of sacrificial material and etching the bottom resist layer prior to depositing the middle portion, of the conductive layer on the mask followed by lifting off the mask and middle portion of the conductive layer.

9. The method of claim 4 wherein said processing the one sequence of materials also includes applying a chemical modifying agent to the mask to develop an undercut therein, prior to depositing middle portion of the conductive layer on the mask followed by lifting off the mask and middle portion of the conductive layer.

10. The method of claim 1 wherein said processing the other sequence of materials to produce the second strata, further includes depositing passivation and cavitation, layers so as to coat the resistive layer defining the fluid heater element of the first strata.

* * * * *